US005213413A

United States Patent [19]

Weathers

[11] Patent Number: 5,213,413

[45] Date of Patent: May 25, 1993

[54] COMBINED LIGHT AND LIGHT SUPPORT BRACKET

[76] Inventor: Monte Weathers, 721 Porter La., Orland, Calif. 95963

[21] Appl. No.: 824,309

[22] Filed: Jan. 23, 1992

[51] Int. Cl.[5] ..... F21S 1/10

[52] U.S. Cl. ..... 362/431; 362/432; 362/382

[58] Field of Search ..... 362/431, 457, 382, 432, 362/95

[56] References Cited

U.S. PATENT DOCUMENTS

| | | | |
|---|---|---|---|
| 2,104,072 | 1/1938 | Carr | 362/432 X |
| 2,806,941 | 9/1957 | Graziani | 362/432 |
| 2,911,525 | 11/1959 | Strom | 362/432 X |
| 4,463,413 | 7/1984 | Shirley | 362/431 X |

FOREIGN PATENT DOCUMENTS

| | | | |
|---|---|---|---|
| 173632 | 12/1960 | Sweden | 362/431 |

*Primary Examiner*—Larry Jones
*Attorney, Agent, or Firm*—Bernhard Kreten

[57] ABSTRACT

An integral light and support provides illumination in areas where temporary lighting is desirable and elongate members such as studs or joists are readily available. The light and support includes a mount assembly which has a diagonal support member having a first bracket on one extreme end of the diagonal support member and a second bracket on another opposite end of the diagonal support member and which brackets conform to opposite sides of the elongate member. Friction between the elongate member and the first and second brackets along with torque produced by having a center of mass of the integral light and support extended away from the front of the elongate member create sufficient force to hold the light in place on the elongate member. The light is readily relocatable on the elongate member by a user by placing the light and support adjacent to the elongate member and rotating. The light and support may also be suspended from a flat wall having nails protruding from the surface through attachment to nail grooves provided. The integral light and support has a light housing that is pivotable and rotatable to direct the light in a variety of different areas without movement of the entire light and support. An electric outlet assembly may also be provided which allows a user to access electric power for operation of other electrical appliances. The integral light and support may also be attachable to elongate members having low friction surfaces without sliding by adjusting of a tightening pin located along the diagonal support member which applies additional force for applying greater friction force.

20 Claims, 2 Drawing Sheets

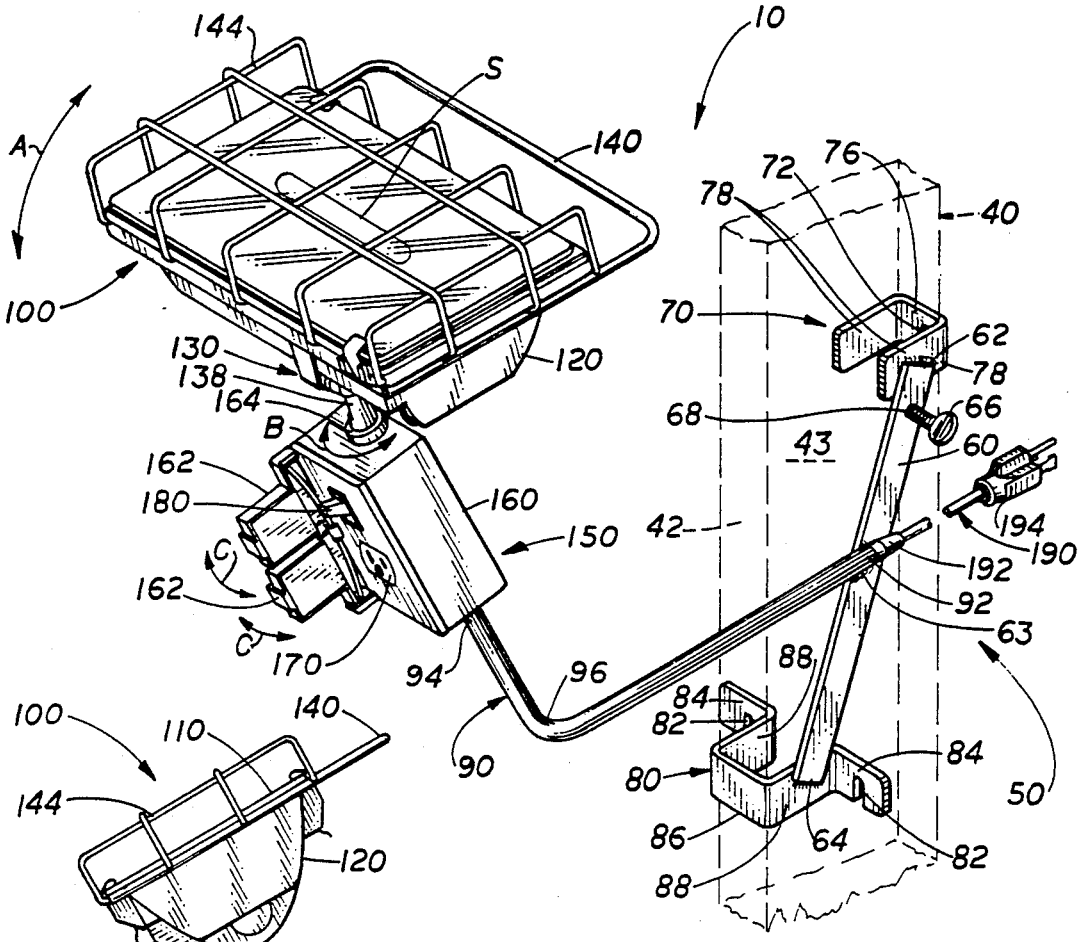
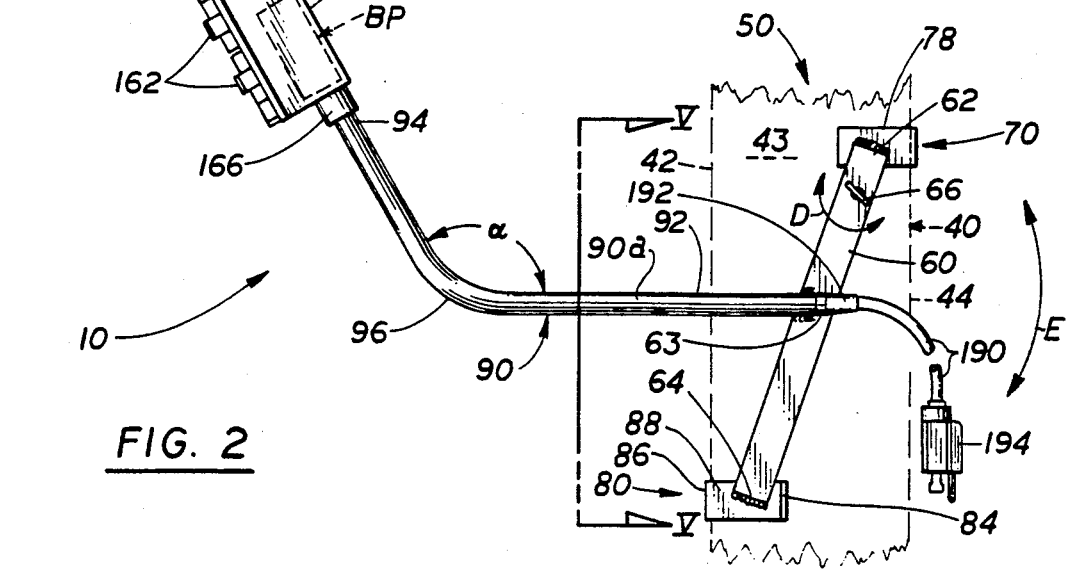
FIG. 2

COMBINED LIGHT AND LIGHT SUPPORT BRACKET

FIELD OF THE INVENTION

The following invention relates to lighting devices. More specifically, this invention relates to portable lights easily suspendable from elongate members such as posts, poles, exposed studs or joists and rafters.

BACKGROUND OF THE INVENTION

Effective temporary lighting is very important in situations where activities occur at night or in areas where, for various reasons, permanent lighting is not in place. A need exists for the temporary lighting to be easily and securely positioned and yet also easily detachable for removal after the lighting necessity passes. In many locations where temporary lighting is required an abundance of narrow elongate structures are available.

In a construction site environment, where work may be performed after dark or in poorly lit areas or in enclosed buildings, which block sunlight, a plurality of erect rectangular cross-section studs are frequently exposed. While some lighting devices exist which can be attached to the readily available studs and other elongate members, none of these devices exhibit the ready adjustability, connectability and disconnectability of the instant device. Another constant need in the construction environment and in other environments where permanent lighting is not available is for a standard electrical outlet providing standard power for running various electric appliances.

No devices known in the prior art provide both the necessary lighting along with providing an integral electric outlet. The device of this invention provides both lighting and an electrical outlet in a structure which is easily connectable and disconnectable from elongate members. Accordingly, a new and useful lighting device is provided.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | PATENT NO. | ISSUE DATE |
|---|---|---|
| F. Beauront, Jr. | 175,407 | March 28, 1876 |
| A. L. Stanford | 730,580 | June 9, 1903 |
| D. C. Lamb | 1,105,083 | July 28, 1914 |
| L. Fort | 1,129,285 | February 23, 1915 |
| W. J. Myers | 1,499,242 | June 24, 1924 |
| Johnston | 3,746,294 | July 17, 1973 |
| Bourhenne | Des. 229,821 | January 8, 1974 |
| Bourhenne | 3,837,597 | September 24, 1974 |
| Hubbard | 4,228,485 | October 14, 1980 |
| Johnson | 5,063,274 | November 5, 1991 |

The patent to Beaumont teaches the use of a stilt for attaching a platform to an elongate member in a manner allowing the device to support a person or other object. The attachment means of Beaumont includes two opposing, parallel restraining plates conforming to and engaging opposite sides of an elongate member. A platform coupled to the plates extends horizontally away from the elongate member such that when force is applied downwardly on the support, the opposite restraining plates are forced into the elongate member, thereby supporting the entire device above ground. While the device of the instant invention uses a coincidentally similar force couple concept to attain attachment to an elongate member, it is distinguished over Beaumont, inter alia, in that it utilizes this basic concept of static physics in providing an adjustable portable lighting device.

The patents to Stanford, Bourhenne, Johnson and Myers also teach the use of the basic concept first disclosed in the Beaumont patent. The device of this application is distinguishable from all of these inventions in that it utilizes this concept in conjunction with a temporary lighting device and in such a manner to provide a readily adjustable and engagible device.

The patent to Lamb teaches the use of an electric light support which is connectable to an elongate member. The device of the instant application is distinguishable from Lamb, inter alia, in that it attaches to the elongate member with only two restricting plates instead of the three required by Lamb. The Lamb device requires three points of contact to the elongate member, and that a portion of the device be flexible to snap around the elongate member. This requires that the Lamb device be installed by a user having two, free hands to distort the two outer contact points vis-a-vis a central contact to straddle the elongate member. It is therefore also difficult to readjust the light. The device of the instant invention is easily attachable by comparison and is detachable and adjustable by a user with only one hand, thereby allowing the user to keep the other hand free for other tasks. Furthermore, the Lamb device fails to provide an electrical outlet device whereas the device of this application provides an electric outlet device for providing power to various tools in the location proximate to the lighted area.

The patents to Fort, Johnston and Hubbard teach lights which use some form of the basic attachment principle utilized by the invention of this application. However, in each of these prior art patents the concept of easy attachment and detachment is not addressed leaving these devices flawed by comparison and unable to effectively address the needs associated with the temporary lighting environment.

SUMMARY OF THE INVENTION

The light and support of this invention is essentially composed of three basic components, including a mount assembly, a light assembly and an electric outlet assembly.

The mount assembly is that portion of the light and support device which adheres to an elongate member in an adjustable attachable and detachable manner. A diagonal support member is included which preferably may be a rigid, elongate construct having an upper bracket fixedly attached to an upper end of the diagonal support member and a lower bracket fixedly attached to a lower end of the diagonal support member. Preferably, at a median point between the upper end and lower end of the diagonal support member, an angled tubular support is fixedly attached.

At least one, and possibly a plurality of threaded openings are provided which pass through the diagonal support member in a direction perpendicular to at least one major surface of the elongate member. The threaded opening is designed to conform to threads of a tightening pin. The tightening pin may be rotated causing it to pass through the diagonal support member and press against a side of the elongate member. When the tightening pin is tightened against the elongate member it provides an additional force for more securely holding the mount assembly to the elongate member.

The upper bracket is a rigid U-shaped construct fixedly attached to the diagonal support member on a side support plate of the U-shaped bracket. Two side support plates of the upper bracket are fixedly attached perpendicular to a first restraining plate of the upper bracket. Both the first restraining plate and the side support plates of the upper bracket exist in planes which are parallel to surfaces of the elongate member.

The lower bracket is fixedly attached to the lower end of the diagonal support member through one of two side support plates. The lower bracket has two side support plates oriented in planes coextensive with the side support plates of the upper bracket. A second restraining plate is fixedly attached to ends of the side support plates such that the second restraining plate and the two side support plates are all in planes coextensive with the side of the elongate member.

The first restraining plate of the upper bracket and the second restraining plate of the lower bracket are in planes parallel to each other and which conform to opposite sides of the elongate member. The second restraining plate of the lower bracket conforms to the front side of the elongate member and the first restraining plate of the upper bracket conforms to a rear side of the elongate member. In other words, the two U-shaped brackets have open portions which face each other but at different elevations.

Fixedly attached to ends of the side support plates opposite the second restraining plate of the lower bracket are two nail groove plates. The two nail groove plates are in a single plane which is parallel to the second restraining plate's plane. Thus, the two nail groove plates extend from the side support plates and away from opposite sides of the elongate member.

Each nail groove plate and the first restraining plate have nail grooves located therein. Each nail groove is a thin slit extending from a lower surface up to an upper portion of each plate but not totally bisecting any of the plates. The width of the nail grooves are sized to receive the shaft of a standard nail. Thus, when no elongate members are available for suspending the mount assembly of the light and support of this invention the mount assembly may suspend from a nail partially driven into a flat surface.

The upper bracket and lower bracket are spaced a distance apart equal to or greater than the width of the elongate member designated for attachment in both the vertical orientation and the horizontal orientation. Thus, when a user desires to attach the light and support to the elongate member, the mount assembly of the light and support can first be oriented with the upper bracket and lower bracket substantially horizontal to each other surrounding the elongate member. Then, the mount assembly may be rotated until the upper bracket comes into contact with the rear surface of the elongate member. At the same time, the lower bracket comes into contact with the front surface of the elongate member. This allows the support plates of each bracket to surround sides of the elongate member because the first restraining plate impacts the rear surface to the elongate member while the second restraining plate impacts the front surface of the elongate member.

The angled tubular support is a hollow cylindrical construct having a mount end and an outlet box end. The mount end is fixedly attached to the diagonal support member at the median point of the diagonal support. The outlet box end is connected to a lower end of the electric outlet box. A bend, located between the mount end and the outlet box end, causes the outlet box end to be higher in elevation than the mount end. An electric cord which supplies power to the light assembly and the electric outlet assembly passes through the interior of the angled tubular support and out the mount end of the angled tubular support. A stress relief is connected to the mount end of the angled tubular support and attaches to the cord, preventing the cord from being displaced relative to the angled tubular support.

The electric outlet assembly is located inside an outlet box which is fixedly attached to the outlet box end of the angled tubular support. The electric outlet assembly includes an electric outlet on a front face of the outlet box which is covered by a protective door. Above the electric outlet is a switch covered by another protective door. The switch is electrically connected to the cord and the outlet such that when the switch is "on", power is supplied to the outlet and when the switch is "off", power is disrupted to the outlet. On an upper surface of the outlet box a swivel mount is located. The swivel mount is attached to the outlet box through a swivel mount reciver. The swivel mount can swivel rotatably with respect to the outlet box.

The light assembly is attached to the rest of the light and support through the swivel mount. The light assembly includes a housing for the light having a flange which includes a pivotable attachment. The pivotable attachment fastens to the swivel mount with a pivot pin. The pivot pin is capable of locking the pivotable attachment allowing the housing to be fixed in a fixed position. Thus, the housing of the light assembly may be pivoted about an axis (e.g. horizontal) of the pivotable attachment's pivot pin to direct the light up and down. The swivel mount may also be rotated about a (vertical) axis allowing the light from the light assembly to be rotated to focus the light in different areas.

Inside the housing is located a source of illumination. A cover of a transparent material is provided covering a front surface of the housing. The transparent cover allows light to pass out of the housing to illuminate a desired area. A cage is provided attached to the housing and circumscribing the cover. The cage protects the transparent cover from damage. A handle extends along the upper surface of the housing allowing a user to easily pivot the housing to redirect the light.

OBJECTS OF THE INVENTION

Accordingly, the primary object of this invention is to provide a light which is easily attachable to and detachable from an elongate member.

A further object of the present invention is to provide a light that is portable.

Another further object to the present invention is to provide a light including an electric outlet allowing electric-power-utilizing appliances to be connected thereto.

Another further object of the present invention is to provide a light which is pivotable and swivelable so that the area being lighted may be adjusted without movement of the entire light.

Another further object of the present invention is to provide a light which connects to an elongate member allowing positioning at various angles.

Another further object of the present invention is to provide a light having a durable construction for use in environments where rough treatment of equipment is not uncommon.

Another further object of the present invention is to provide a light which is easy to build, can be formed from commonly available subcomponents and is easily maintained.

Another further object of the present invention is to provide a light which can be suspended from an elongate member and also be hanged from a wall.

Another further object of the present invention is to provide a light having additional friction creating means allowing the light to attach to elongate members having low friction surfaces.

Another further object of the present invention is to provide a light which can not only hang from an elongate member but also can rest on the floor with the illumination means suspended sufficiently from the ground to allow for necessary heat dissipation between the light and the associated environment, thereby minimizing the likelihood of combustion of materials proximate to the light.

Viewed from a first vantage point it is object of the present invention to provide a portable light comprised of a source illumination, a substantially rigid mounting bracket having means for connecting securely to a post, in such a manner that the post could be positioned in any of different orientations, and a light support interposed between said mounting bracket and said source of illumination and supporting said source of illumination away from said mounting bracket.

View from a second vantage point it is an object of the present invention to provide a lighting device which includes means for straddling an elongate member comprised of a diagonal support member having a first zone proximate to a front face of the elongate member and a second zone proximate to a rear face of the elongate member, said first zone having means to address said front face, said second zone having means to address said rear face, and a source of illumination extending from the diagonal support member.

Viewed from a third vantage point is an object of the present invention to provide a method for suspending a light from an elongate member including steps of configuring a light to have two contact zones located to contact opposites sides of the elongate member, displacing the contact zones sufficiently along the length of the elongate member and from each other to allow the light to exhibit a turning moment, thereby engaging and disengaging the contact zones against opposite sides of the elongate member, locating a center of mass of the light in a position relative to a center point between the contact zones to cause the turning moment about the center point opposite to a moment generated by the elongate member in resisting compression by the contact zones, positioning the light proximate to the elongate member with the contact zones on opposite sides of the elongate member, and rotating the light until the contact zones engage the elongate member; whereby the light may easily be suspended from the elongate member by a user without any other fastening means being necessary.

These and other objects will be made manifest when condidering the following detailed specification when taken in conjunction with the appended drawing figures.

BRIEF DESCRIPTION OF THE DRAWINGS

FIG. 1 is isometric view of the invention in position in its desired environment.

FIG. 2 is a side view of that which is shown in FIG. 1.

DESCRIPTION OF PREFERRED EMBODIMENTS

Figure 3:
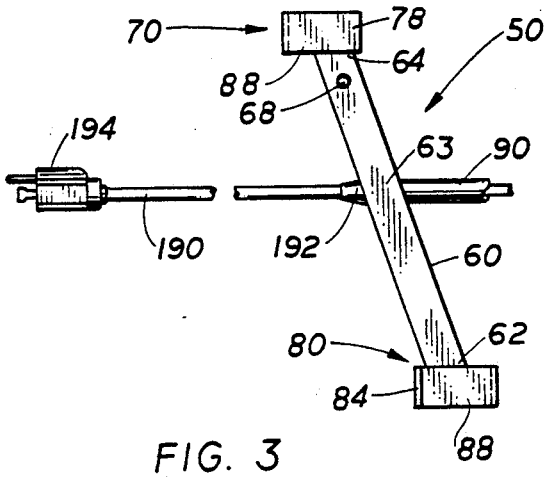
FIG. 3 is a left side view of a portion of the invention.
Figure 4:
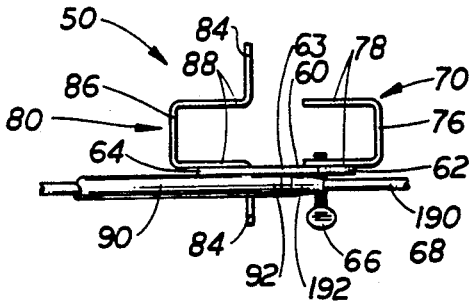
FIG. 4 is a top view of that which is shown in FIG. 3.

Referring now to the drawings wherein like references represent like parts throughout, numeral 10 is directed to a light and support for providing illumination to an insufficiently lighted area. The light and support 10 is composed of a mount assembly 50 which attaches the light and support 10 to an elongate member, such as a stud 40, a light assembly 100 including an illumination means and an electric outlet assembly 150 providing a source of power to other electrical power requiring equipment.

In essence, the mount assembly 50 is composed of a diagonal support member 60 having an upper bracket 70 fixedly attached to the diagonal support member's upper end 62 and a lower bracket 80 fixedly attached to the diagonal support member's lower end 64. The upper bracket 70 and the lower bracket 80 engage the stud 40, thereby suspending the mount assembly 50 above ground. An angled tubular support 90 is fixedly attached to the diagonal support member 60 and extends away from the diagonal support member 60. Connected to the angled tubular support 90 is the light assembly 100 and the electric outlet assembly 150. Power may be supplied to the electric outlet assembly 150 and the light assembly 100 through a cord 190 which passes through an interior of the angled tubular support 90. Alternatively, a rechangeable battery pack BP may be used (and integral for example with outlet 150) to remotely power the light and support 10. The light assembly 100 attaches to the mount assembly 50 through a pivotable attachment 130 which allows the light assembly 100 to pivot and rotate allowing light from the light assembly 100 to be directed in a variety of different directions without movement of the mount assembly 50.

Although brackets 70 and 80 are used with locational descriptors such as "upper" and "lower" respectively, should the light support 10 be deployed upon a joist, for example, these brackets 70, 80 could be denominated "lateral" or "left" and "right" for example.

More specifically, and referring to FIGS. 1 and 2, the light and support 10 is shown attached to a stud 40 (shown in phantom). The light and support 10 attaches to the stud 40 through the mount assembly 50. The mount assembly 50 includes a diagonal support member 60, an upper bracket 70, a lower bracket 80 and an angled tubular support 90. The diagonal support member 60 is a rigid elongate structure having an upper end 62 and a lower end 64. A median point 63 of the support member 60 is located approximately halfway between the upper end 62 and the lower end 64.

Figure 5:
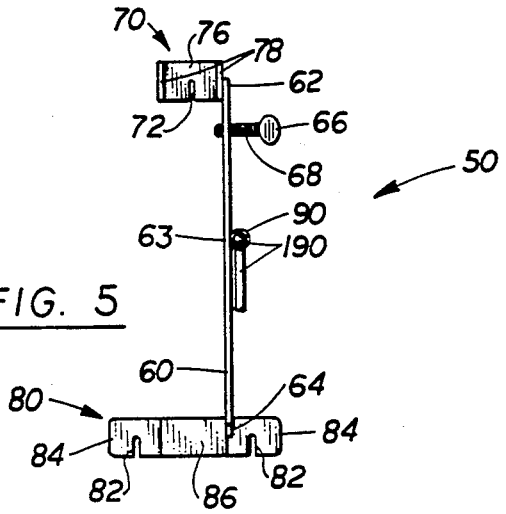
FIG. 5 is a front view of that which is shown in FIG. 3.

The upper bracket 70 is fixedly attached to the diagonal support member 60 for example by welding. The upper bracket 70 is a rigid unitary mass including two spaced, vertically oriented side support plates 78 fixedly attached perpendicularly to an interposed first restraining plate 76. Thus, the two side support plates 78 are oriented in planes parallel to each other. The two side support plates 78 are located a distance apart substantially equal to or greater than a width of the stud 40. Thus, the upper bracket 70 can fit around one rear side 44 (FIG. 2) of the stud 40. The first restraining plate 76 may include a nail groove 72 (FIG. 5) which extends from a lower edge of the first restraining plate 76 up into a midportion of the first restraining plate 76. The nail groove 72 is of a width similar to the shaft of a nail 30 for reasons to be discussed.

The lower bracket 80 is a rigid unitary mass comprised of two sides support plates 88 in parallel planes on each side of a second restraining plate 86 and preferably having two nail groove plates 84 extending in a plane parallel to and spaced from a plane within which the second restraining plate 86 resides. The nail groove plates 84 are located closer to a rear side 44 (FIG. 2) of the stud 40 than is the second restraining plate 86 which abuts the front side 42 of stud 40. Each nail groove plate 84 has a nail groove 82 sized and oriented similar to the nail groove 72 located in the upper bracket 70. The lower bracket 80 is fixedly attached to the lower end 64 of the diagonal support member 60. Thus, the plates 84 are at edges of side plates 88 opposite from restraining plate 86.

Both the upper bracket 70 and the lower bracket 80 extend from respective extremities of the diagonal support member 60, as seen in FIG. 1. The upper bracket 70 and the lower bracket 80 are spaced a sufficient distance apart to accommodate a width of the stud 40.

A threaded opening 68 passes through the diagonal support member 60 providing access to a side of the stud 40 through the diagonal support member 60. A tightening pin 66 is provided having threads conforming to the threads of the threaded opening 68. The tightening pin 66 is rotatable by a user's hand causing the tightening pin 66 to pass through the diagonal support member 60 toward the stud 40. When the device 10 is deployed on a stud thinner than the space between side plates 78 and 88, the pin 66 can take the "play" (clearance) out of the brackets 70, 80.

The angled tubular support 90 has a mount end 92 and an outlet box end 94. The mount end 92 is fixedly attached to the diagonal support member 60 at the median point 63. The angled tubular support 90 extends forward away from the diagonal support member 60. The angled tubular support 90 is a hollow cylindrical construct having a bend 96 located between the mount end 92 and the outlet box end 94. The bend 96 creates an interior angle $\alpha$ in the angled tubular support 90 preferably of approximately 120°. The bend 96 is located approximately 3/5 of the way from the mount end 92 to the outlet box end 94. Thus, the bend 96 is located closer to the outlet box end 94 than the mount end 92.

When the light and support 10 is located on a stud 40, therefore, the support 90 has a leg **90*a* which is substantially horizontal and extends to the mount end 92. Were the light and support 10 connected to a horizontally oriented joist, leg 90*a* would be substantially vertical. This scenario can be visualized precisely by rotating FIG. 2** ninety degrees counterclockwise.

Figure 6:
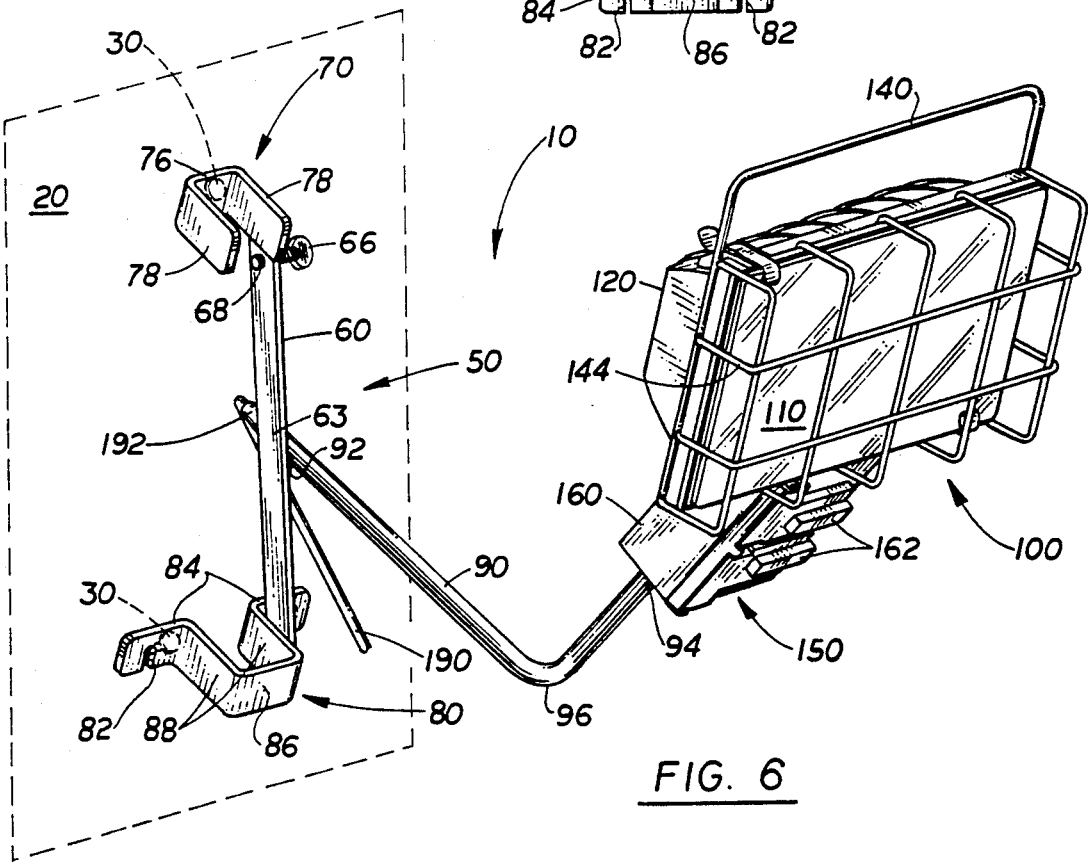
FIG. 6 is a isometric view of the invention in a second intended environment.

The electric outlet assembly 150, shown in FIGS. 1, 2 and 6, attaches to the outlet box end 94 of the angled tubular support 90. The electric outlet assembly 150 is housed within an outlet box 160. The outlet box 160 attaches to the outlet box end 94 through a ferrule-like support receiver 166. On a front surface of the outlet box 160 is located a standard three prong electric plug receiver outlet 170 and a switch 180. Both the plug receiver outlet 170 and the switch 180 are covered by protective doors 162. The protective doors 162 are openable (as shown in FIG. 1) and closable (as shown in FIG. 2) by rotation along arrow "C" to protect the switch 180 and plug receiver outlet 170.

On an upper surface of the outlet box 160 is located a swivel mount receiver 164. The swivel mount receiver 164 is sized to receive a swivel mount 138. The swivel mount 138 forms a part of a pivotable attachment 130. The light assembly 100 includes a housing 120 having a flange 124 on a lower rear end which receives a pivot pin 134. The flange 124, the pivot pin 132 and the swivel mount 138 together comprise the pivotable attachment 130. The pivot pin 132 has a pivot pin head 134 which is easily rotatable by a user's hand. The pivot 132 is rotatable tightening the pivotable attachment 130 to prevent pivoting of the flange 124 and the swivel mount 138 about the pivot pin 132. A power cord 190 passes through the swivel mount 138 from the outlet box 160 to provide power to the light assembly 100.

The electric outlet assembly 150 is wired such that the electric power cord 190 which passes through the angled tubular support 90 provides power to the receiver 170. The cord 190 extends out of the mount end 92 of the angled tubular support 90 and may have a plug 194 at its end. A stress relief 192 is located at the junction between the cord 190 and the mount end 92. The plug 194 is preferably a grounded standard three prong electric plug 194. The plug receiver outlet 170 is preferably a standard ground fault interrupt receptacle type receiver. The outlet box 160 may also include a temporary power supply such as a known battery-transformer arrangement to provide power in the event an outlet for plug 194 is not available.

A source of illumination is provided inside the housing 120. A front surface of the housing 120 has a transparent cover 110. The transparent cover 110 is circumscribed by a cage 144. The cage 144 includes rigid wires which protect the transparent cover 110 from damage. A handle 140 extends from an upper edge of the housing 120 which is sized to be easily grippable by a user to pivot the housing 120 about the pivotable attachment 130 (i.e. along arrow "A") when the pivot pin 132 is loosened.

In use and operation, the light and support 10 is attachable to any stationary elongate member such as a stud 40 joist, pipe etc. in the following manner. The integral light and support device 10 is rotated such that the diagonal support member 60 is initially oriented substantially horizontally with respect to the vertical stud 40. The light and support device 10 is then moved toward the stud 40 until the diagonal support member 60 impacts a lateral side 43 of the stud 40. Next, the light and support 10 are rotated along arrow "E" shown in FIG. 2, causing the upper bracket 70 to move upwards and the lower bracket 80 to move downwards until the upper bracket 70 impacts the rear side 44 of the stud 40 and the lower bracket 80 impacts the front side 42 of the stud 40. The mount assembly 50 then becomes attached to the stud 40 provided there is enough friction between the first restraining plate 76 and the rear side 44 of the stud 40 and the second restraining plate 86 and the front side 42.

With the light assembly 100 and the electric outlet assembly 150 cantilevered adjacent the outlet box end 94 of the angled tubular support 90, a torque is applied to the mount assembly 50 equal to the mass of the cantilevered portion multiplied by the distance from an effective center of mass to the median point 63 of diagonal support 60. This torque is opposed by a horizontal couple force exerted by the stud 40 against the first restraining plate 76 and the second restraining plate 86. This horizontal force coupled with the friction inherent in the surfaces of the stud 40 and the mount assembly 50 create a vertical upward force sufficient enough to suspend the light and support 10 above ground. Thus, the device 10 can also be easily reoriented along the length of the stud 40 by merely overcoming the locking torque and raising or lowering the device 10.

If the elongate member or stud 40 from which the mount assembly 50 is attached has a low friction surface, the tightening pin 66 is rotatable along arrow "D", shown in FIG. 2, causing the tightening pin 66 to exert pressure against the side of the elongate member. The tightening pin 66 increases the horizontal force exerted against the elongate member decreasing the minimum amount of friction necessary to suspend the light and support 10 above ground.

In areas where any elongate member is not available, the mount assembly 50 may be temporarily attached to a wall 20 having nails 30 partially extending therefrom, as shown in FIG. 6. The nail grooves 72 and 82 are placed over the protruding nails 30 in the wall 20 suspending the light and support 10 from the wall 20.

Once the plug 194 is connected to the appropriate power supply, the light assembly 100 radiates light from the source S of illumination. Light from the source S of illumination radiates out of the housing 120 through the transparent cover 110. If the light is not shining in a proper position, the pivot pin 132 may be loosened by a user by rotation along arrow "F", as shown in FIG. 2, and the housing 120 may be rotated upwards and downwards e.g. along arrow "A" of FIG. 1. Furthermore, the housing 120 may be rotated from side to side through rotation of the housing 120 and swivel mount 138 within the swivel mount receiver 164 of the outlet box 160 along arrow "B", also shown in FIG. 1. In this way, the light may be directed a variety of different ways without adjustment of the mount assembly 50.

When an additional electrical appliance is to be used along with the light and support 10 the protective door 162 over the plug receiver outlet 170 may be opened by rotation along arrow "C", shown in FIG. 1, allowing a plug from the appliance to be plugged thereinto. The protective door 162 over the switch 180 may be opened by rotation along arrow "C", shown in FIG. 1, and the switch 180 moved to allow power to energize the appliance. Alternatively, the receptacle outlet 170 may be always "hot" (i.e. active) and the switch 180 could power the light source S. In this way, an electrical appliance may be used along with the light and support 10. When a user desires to move the light and support 10, a reverse procedure of that involved in mounting the light and support 10 may be followed to move the light and support 10 to a new location where illumination is desired.

In an alternative embodiment, an additional threaded opening and tightening pin are provided along the diagonal support member 60 to provide additional friction to the friction provided by tightening pin 66. Also in an alternative embodiment, the switch 180 may be replaced with a second receiver 170 allowing two electrical appliances to be connected directly to the light and support 10.

The light and support 10 may also be utilized on a flat horizontal surface by inverting the light and support 10 (Visualization of this use is exhibited by inverting the light and support 10 as shown in FIG. 6). The light and support 10 may then be rested with the handle 140 on the ground and an upper edge of the first restraining plate 76 of the upper bracket 70 resting on the ground. In this configuration, the plug receiver outlet 170 and switch 180 of the electrical outlet assembly 150 are located above the light assembly 100. The handle 140 holds the light above ground protecting the transparent cover 110 from dirt and debris and also acts as a heat diffusion device preventing the light assembly 100 from excessively heating the supporting horizontal surface.

The light and support device 10 is connectable to elongate members other than studs 40, at various different angles of inclination. The bend 96 locates a center of mass of the light and support 10 closer to the upper bracket 70 than to the lower bracket 80 allowing the light and support 10 to more easily attach to elongate members oriented close to horizontal, such as rafters, joists, poles, plumbing fixtures and pipes, etc.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A portable light for attachment to a post, the post being positioned in any of a multiplicity of different orientations, the post having opposite first and second sides, comprising, in combination:

a source of illumination, a substantially rigid mounting bracket having means for connecting securely to the post, and a light support interposed between said mounting bracket and said source of illumination, and said light support supporting said source of illumination away from said mounting bracket; and wherein said mounting bracket includes a first U-shaped restraining plate having an open portion which allows said U-shaped plate to conform around the first side of the post, a second U-shaped restraining plate having an open portion which allows said U-shaped plate to conform around the second side of the post opposite the first side, said U-shaped plates laterally spaced along a long axis of the post, and a diagonal support member fixedly attached between side portions of said first U-shaped restraining plate and said second U-shaped restraining plate affixing said open portions of each said U-shaped restraining plate so that they face toward each other but are laterally off-set, said first restraining plate and said second restraining plate confined to two substantially parallel planes separated by a distance substantially conforming to the distance between the first and second sides of the post upon which said mounting bracket connects, whereby said first restraining plate and said second restraining plate may simultaneously be oriented parallel to the opposite sides of the post with said diagonal support member adjacent to an intermediate side of the post.

2. The portable light of claim 1 wherein said light support fixedly attaches to said diagonal support member and extends away from said diagonal support member in a direction substantially perpendicular to said parallel planes;

whereby when the post is oriented vertically the weight of said lighting means and said light support apply a torque to said mounting bracket creating force between said first restraining plate and the post and said second restraining plate and the post to support said portable light above ground.

3. The portable light of claim 1 wherein said mounting bracket has a plurality of nail receiving grooves, each said groove of a width equal to the width of a body portion of a nail;

whereby said mounting bracket may also connect securely to a nail protruding from a wall by engagement of said mounting bracket with a head of the nail.

4. The portable light of claim 1 wherein said light support has a bend positioning said source of illumination closer to said upper bracket than said lower bracket;

whereby when said portable light is attached to a vertical post the lighting means is further elevated for more effective illumination, and when said portable light is attached to a horizontal post the weight of said lighting means applies a torque to said mounting bracket creating sufficient force between said first restraining plate and the post and said second restraining plate and the post to securely attach said portable light to the horizontal post.

5. The portable light of claim 1 wherein an electric plug receptacle is interposed between said source of illumination and said light support, said receptacle coupled to a power cord which supplies power to said lighting means and said receptacle.

6. The portable light of claim 5 wherein said receptacle has both a plug receiver and a switch, said switch interrupting power to said plug receiver.

7. A portable light for attachment to a post, the post being positioned in any of a multiplicity of different orientations, comprising, in combination:

a source of illumination, a substantially rigid mounting bracket having means for connecting securely to the post, and a light support interposed between said mounting bracket and said source of illumination, and said light support supporting said source of illumination away from said mounting bracket, wherein said mounting bracket includes:

an upper bracket having a first restraining plate and conforming around one side of the post, a lower bracket having a second restraining plate and conforming around an opposite side of the post, and a diagonal support member fixedly attached between said upper bracket and said lower bracket, said first restraining plate and said second restraining plate confined to two substantially parallel planes separated by a distance substantially conforming to the width of the post upon which said mounting bracket connects;

whereby said first restraining plate and said second restraining plate may simultaneously be oriented parallel to opposite sides of the post with said diagonal support member adjacent to an intermediate side of the post; and wherein said diagonal support member has a threaded hole passing there through which receives a screw, whereby said screw may be tightened against the post further affixing said mounting bracket to said post.

8. A portable light for attachment to a post, the post being positioned in any of a multiplicity of different orientations, comprising, in combination:

a source of illumination, a substantially rigid mounting bracket having means for connecting securely to the post, and a light support interposed between said mounting bracket and said source of illumination, and said light support supporting said source of illumination away from said mounting bracket, wherein said mounting bracket includes:

an upper bracket having a first restraining plate and conforming around one side of the post, a lower bracket having a second restraining plate and conforming around an opposite side of the post, and a diagonal support member fixedly attached between said upper bracket and said lower bracket, said first restraining plate and said second restraining plate confined to two substantially parallel planes separated by a distance substantially conforming to the width of the post upon which said mounting bracket connects;

whereby said first restraining plate and said second restraining plate may simultaneously be oriented parallel to opposite sides of the post with said diagonal support member adjacent to an intermediate side of the post, wherein said light support fixedly attaches to said diagonal support member and extends away from said diagonal support member in a direction substantially perpendicular to said parallel planes;

whereby when the post is oriented vertically the weight of said lighting means and said light support apply a torque to said mounting bracket creating force between said first restraining plate and the post and said second restraining plate and the post to support said portable light above ground; and wherein a pivotable attachment means is interposed between said source of illumination and said light support allowing said source of illumination to be oriented facing in a variety of different directions without reorienting said mounting bracket or said light support.

9. A portable light for attachment to a post, the post being positioned in any of a multiplicity of different orientations, comprising, in combination:

a source of illumination, a substantially rigid mounting bracket having means for connecting securely to the post, and a light support interposed between said mounting bracket and said source of illumination, and said light support supporting said source of illumination away from said mounting bracket, wherein said mounting bracket includes:

an upper bracket having a first restraining plate and conforming around one side of the post, a lower bracket having a second restraining plate and conforming around an opposite side of the post, and a diagonal support member fixedly attached between said upper bracket and said lower bracket, said first restraining plate and said second restraining plate confined to two substantially parallel planes separated by a distance substantially conforming to the width of the post upon which said mounting bracket connects;

whereby said first restraining plate and said second restraining plate may simultaneously be oriented parallel to opposite sides of the post with said diagonal support member adjacent to an intermediate side of the post, wherein said light support fixedly attaches to said diagonal support member and extends away from said diagonal support member in a direction substantially perpendicular to said parallel planes;

whereby when the post is oriented vertically the weight of said lighting means and said light support apply a torque to said mounting bracket creating force between said first restraining plate and the post and said second restraining plate and the post to support said portable light above ground; and wherein said lighting means is a light source disposed in a housing having a transparent cover on one side thereof and a cage surrounding said transparent cover;

whereby said cover allows light to escape said housing and said cage protects said cover from damage.

10. The portable light of claim 9 wherein a handle is fixedly attached to an upper surface of said housing and a pivotable attachment means is interposed between said housing and said light support;

whereby said housing may pivot to redirect said light source by grasping said handle and pivoting said housing about said pivotable attachment means.

11. A lighting device straddling an elongate member comprising, in combination:

a diagonal support member having a first end with a first zone locatable proximate to a front face of the elongate member and a second end with a second zone locatable proximate to a rear face of the elongate member which is opposite the front face at a location which is further spaced laterally along the elongate member, said first zone having a U-shaped restraining plate oriented to surround a portion of the front face, said second zone having a U-shaped restraining plate oriented to surround a portion of the rear face, and a source of illumination extending from said diagonal support member between said first end and said second end to a point nearer the front face of the elongate member than the rear face.

12. The lighting device of claim 11 wherein said first zone is below said second zone and said source of illumination extends forward from the diagonal support to a point sufficiently distant from said front face to position a center of mass of said lighting device forward of a median point between said first zone and said second zone;

whereby said center of mass imparts a torque about said median point causing said first zone and said second zone to be forced against front and rear surfaces of the elongate member holding said lighting device to said elongate member.

13. The lighting device of claim 12 wherein said source of illumination and said center of mass are positioned nearer said second zone than said first zone;

whereby torque imparted on said lighting device is increased when the elongate member is non-vertical and said light is positioned higher for greater illumination.

14. The lighting device of claim 11 wherein said "U"-shaped restraining plate of said first zone has a flat restricting plate bounded on each side by perpendicularly extending side support plates, said side support plates spaced a distance apart similar to a width of said elongate member; and said "U"-shaped restraining plate of said second zone has a flat restricting plate bounded on each side by perpendicularly extending side support plates, said side support plates spaced a distance apart similar to a width of said elongate member;

whereby said first zone and said second zone can prevent said lighting device from motion relative to the elongate member.

15. The lighting device of claim 11 wherein said first zone and said second zone have nail grooves formed therein having a width similar to a nail shaft and opening on a lower side thereof;

whereby said lighting device can be suspended from a plurality of nails fastened to a surface without the elongate member being utilized.

16. The lighting device of claim 11 wherein an electric plug receptacle is included adjacent said source of illumination and means to operatively couple said device to a source of power, whereby electric equipment may receive power from said receptacle.

17. The lighting device of claim 11 wherein said source of illumination has means to concentrate light in a specific area and wherein said source of illumination includes pivoting means capable of adjusting the orientation of said source of illumination;

whereby the specific area receiving concentrated light can be moved without moving the lighting device.

18. The lighting device of claim 11 wherein an elongate member attachment means is connected to said lighting device adjustable to securely grab the elongate member;

whereby said lighting device may more securely attach to the elongate member when the elongate member exhibits low friction surfaces.

19. A method for suspending a light from an elongate member, including steps of:

configuring a support of the light to have two contact zones located to contact opposite sides of the elongate member each contact zone having U-shaped restraining plates oriented to face the elongate member, displacing the contact zones along a long axis of the elongate member with a diagonal support affixed therebetween, with sufficient separation to allow the support to rotate in a manner engaging and disengaging the restraining plates with opposite sides of the elongate member, locating a center of mass of the light and support in a position, relative to a center point between the contact zones, which causes a moment about the center point opposite and equal to a moment generated by the elongate member in resisting compression by the contact zones, rotating the support to a position with a line between the contact zones substantially perpendicular to the elongate member with the diagonal support more distant from the elongate member than the line between the contact zones, positioning the light support proximate to the elongate member by translating the light support directly toward a side of the elongate member between the opposite sides of the elongate member with the contact zones on opposite sides of the elongate member, rotating the light support until the restraining plates engage the elongate member, and releasing the support;

whereby the light may easily be suspended from the elongate member by a user.

20. A pole supported light, comprising in combination:

a pair of U-shaped brackets oriented parallel to each other, each having a bight portion and first and second legs structured as plates;

a diagonal rod interposed between said brackets such that at extremities of said rod, said rod is connected between one leg of each bracket;

said brackets held in fixed position by said rod such that said bight portion and legs of one said U-shaped bracket faces toward said bight portion and legs of said other U-shaped bracket, a light support connected to said rod; and a light connected to said support.

* * * * *